United States Patent [19]

Johnson

[11] 4,340,246

[45] Jul. 20, 1982

[54] LATCH ASSEMBLY

[75] Inventor: Larry K. Johnson, Sterling, Ill.

[73] Assignee: Lawrence Brothers, Inc., Sterling, Ill.

[21] Appl. No.: 139,781

[22] Filed: Apr. 14, 1980

[51] Int. Cl.[3] ..... E05C 5/02

[52] U.S. Cl. ..... 292/113; 292/108; 292/DIG. 49

[58] Field of Search ..... 292/113, 114, 65, 66, 292/DIG. 49, 52, 100, 63, 69, 240, 60, 62, 108

[56] References Cited

U.S. PATENT DOCUMENTS

| | | | |
|---|---|---|---|
| 473,126 | 4/1892 | Piers | 292/60 |
| 703,962 | 7/1902 | Lydon | 292/113 |
| 1,566,689 | 12/1925 | O'Connor | 292/113 |
| 1,928,734 | 10/1933 | Nelson | 292/60 |
| 2,497,982 | 2/1950 | Deyo | 292/113 |
| 4,098,530 | 7/1978 | Edeus | 292/113 |

FOREIGN PATENT DOCUMENTS

| | | | |
|---|---|---|---|
| 1102953 | 10/1955 | France | 292/60 |
| 92392 | 10/1959 | Netherlands | 292/60 |
| 903885 | 8/1962 | United Kingdom | 292/106 |

*Primary Examiner*—Roy D. Frazier
*Assistant Examiner*—Peter A. Aschenbrenner
*Attorney, Agent, or Firm*—Trexler, Bushnell & Wolters, Ltd.

[57] ABSTRACT

A latch assembly holds a free hanging door against a support frame. The assembly includes a base adapted to be mounted to the support frame which includes a latch recess. A handle is pivotally mounted to the base and has a latch projection at one end thereof. A hook is coupled to the other end of the handle and the latch projection is arranged to enter the latch recess and be lockingly retained therein as the handle is rotated to a position whereat the door is drawn firmly against the support frame for locking the door and the handle.

6 Claims, 11 Drawing Figures

10
12
14
20
16
18

26
52
54
50
58
56
10
74
42
20
16
34
22
24
28
44
38
30
36
40
32
46
48

48
24
42
34
52
22
26
38
36
40
32

50
22
74
64
72
42
62
70
60
66
68
24

50
42
68
74
4
62
24
60
66
64
72
22
44
30
48
46
32

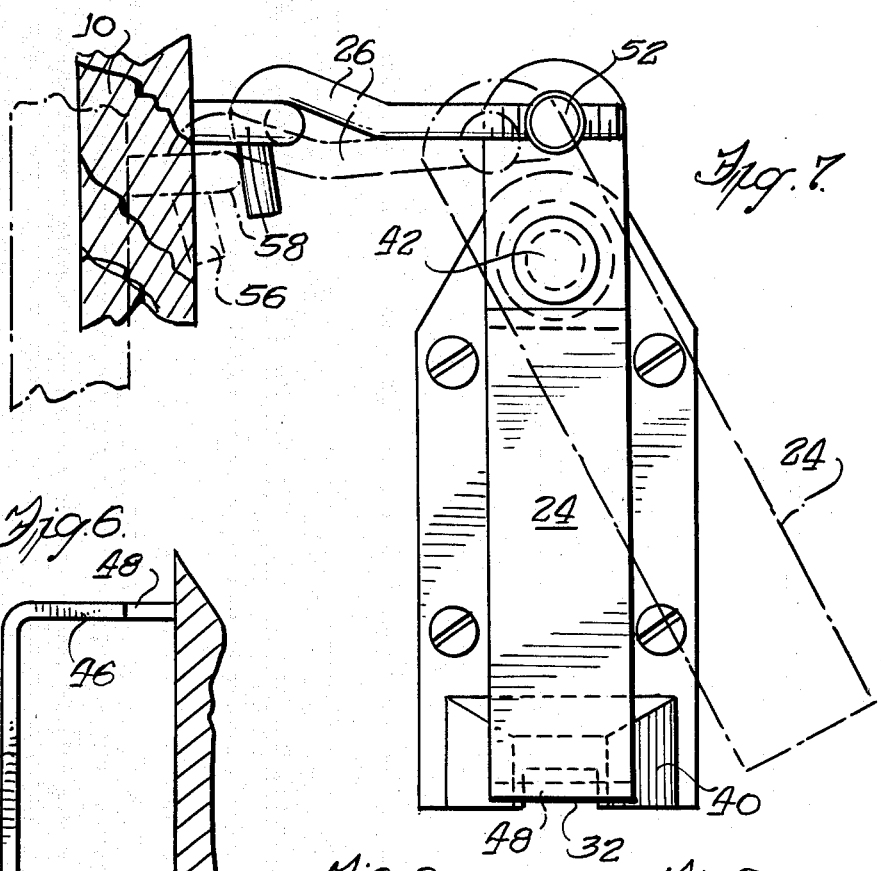
Fig. 7.
Fig. 6.
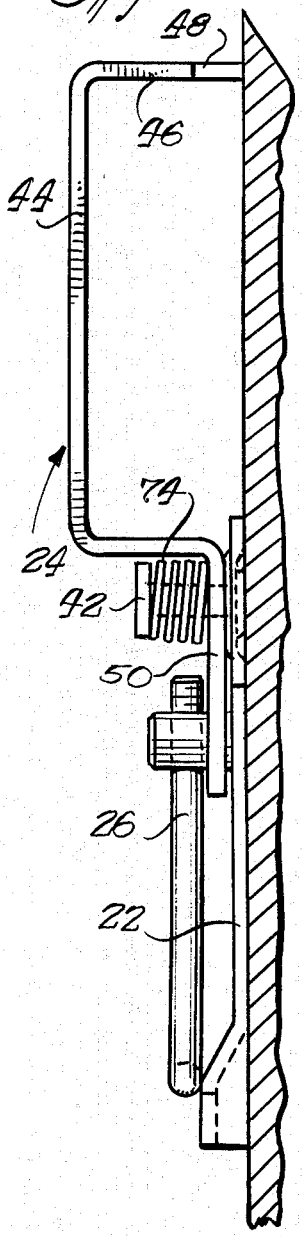
Fig. 8.
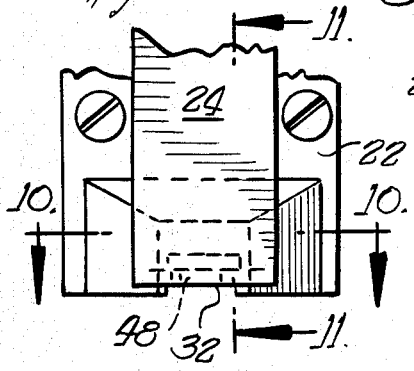
Fig. 9.
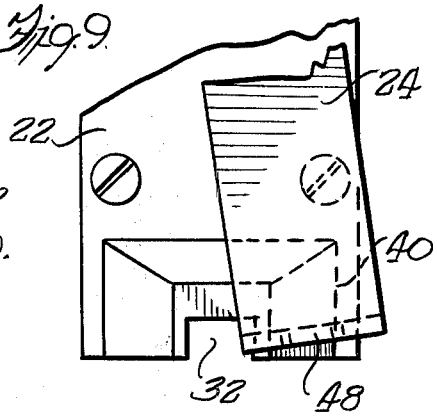
Fig. 10.
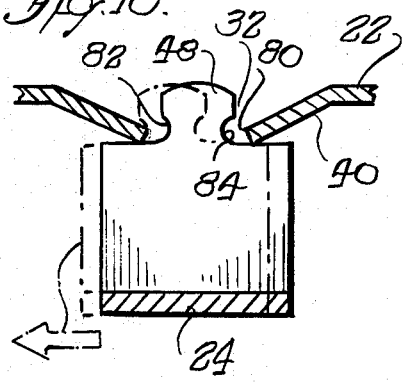
Fig. 11.
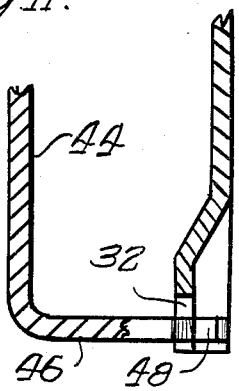

LATCH ASSEMBLY

BACKGROUND OF THE INVENTION

The present invention is generally directed to lock assemblies and more particularly to a latch assembly for holding a free hanging door against a supporting frame.

Industrial and agricultural buildings often include a relatively large sliding door to permit storage of rather large industrial or agricultural equipment. The doors are relatively light, normally being constructed from a metal frame with sheet metal engaged thereover. The doors are hung on a frame for sliding movement along a track so that the doors can slide relative to the door frame. The bottom of the doors are generally not fixed so that the doors have a tendency to pivot outwardly When strong winds are encountered, the wind tends to force the doors outwardly which, under extreme circumstances, may cause damage to the doors. This phenomenon is also enhanced due to the pressure differential that is created in high wind situations such that the pressure inside the building tends to push the doors outwardly.

In order to preclude "flapping" of such doors under such conditions, latch assemblies have been employed which draw the doors up against the door support frame. The latches, when operated, draw the doors up to the building or door frame to achieve a snug fit therebetween. As a result, damage to the doors during high wind conditions is thereby precluded.

While latch assemblies for such use have been generally successful, there remains a need for an improved latch assembly which provides features not found in the latch assemblies developed heretofore. For example, it is most desirable for the latch assemblies to be out of the way of the door opening when the doors are opened to permit equipment to be passed through the door opening. Furthermore, it is most advantageous to have a latch assembly which is self-locking so that the doors may be rapidly drawn up against the door frame under serious wind conditions with little effort. Additionally, it is most desirable to have such a latch assembly which is non-handed, that is capable of right or left hand mounting.

It is therefore a general object of the present invention to provide a new and improved latch assembly for holding a free hanging door against a support frame.

It is a more particular object of the present invention to provide a new and improved latch assembly which is non-handed (i.e. neither right nor left hand) and self-latching.

It is a still further object of the present invention to provide a new and improved latch assembly which may be held in a rest condition with no portion thereof extending into the door opening.

The invention therefore provides a latch assembly for holding a free hanging door against a support frame which includes a substantially planar base adapted to be mounted on the support frame wherein the base includes a raised portion at one end thereof and a latch recess within the raised portion. The latch assembly further includes a handle member pivotally mounted to the base at a pivot point intermediate the ends thereof, with the handle member including a latch projection at one end thereof and a hook coupled to the end of the handle member opposite the latch projection. The latch assembly further includes a yieldable biasing means at the pivot point for urging the handle member against the base. The latch projection is arranged to enter the latch recess and be retained therein by the biasing means upon the door being firmly against the support frame for locking the handle and the door.

BRIEF DESCRIPTION OF THE DRAWINGS

FIG. 6 is a side plan view of the latch assembly as illustrated in FIG. 5;

FIG. 7 is a front elevational view illustrating the operation of the latch assembly of FIG. 2;

FIG. 8 is a partial front elevational view illustrating the handle member in a locked position with respect to the base member of the latch assembly;

FIG. 9 is a front elevational view similar to FIG. 8 illustrating the manner in which the latch projection of the handle member is guided into the latch recess within the base member of the latch assembly;

FIG. 10 is a cross-sectional view taken generally along lines 10—10 of FIG. 8; and FIG. 11 is a cross-sectional view taken along lines 11—11 of FIG. 8.

DESCRIPTION OF THE PREFERRED EMBODIMENT

Figures 1, 2, 3, 4, 5:
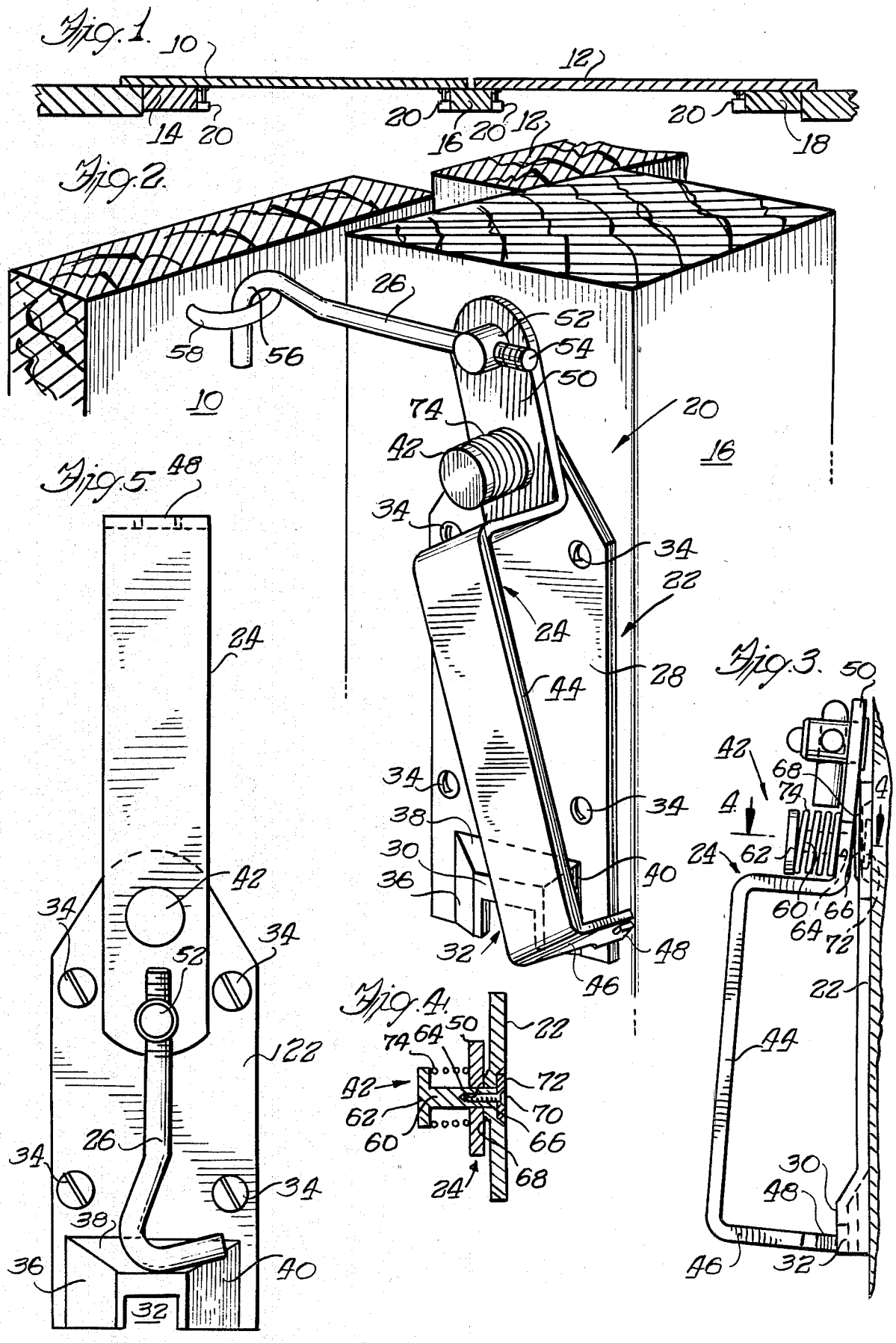
FIG. 1 is a partial cross-sectional view illustrating a pair of free hanging doors being held against a door support frame by latch assemblies embodying the present invention.
FIG. 2 is a perspective view of a latch assembly embodying the present invention.
FIG. 3 is a side plan view of the latch assembly of FIG. 2.
FIG. 4 is a sectional view through the pivot means for the handle member, taken generally along the line 4—4 of FIG. 3.
FIG. 5 is a front plan view of the latch assembly of FIG. 2 showing the handle member in a rest condition with no portion of the latch assembly extending into the door opening.

Referring now to FIG. 1 there is shown a free hanging door comprising door panels 10 and 12 being held against upstanding door frame support members 14, 16, and 18 by latch assemblies 20 embodying the present invention. The door panels 10 and 12 may be formed from solid material such as wood or be formed from sheet metal secured to an inner frame structure. The latch assemblies 20 are secured to the respective frame members 14, 16, and 18 and are arranged to draw the door panels 10 and 12 against the door frames to preclude swinging of the door panels. One such latch assembly 20 is shown in detailed perspective in FIG. 2.

The latch assembly 20 generally includes a base member 22, an actuating member or handle 24, and a hook member 26. The base member 22 includes a major substantially planar portion 28 and a raised portion 30 at one end which includes a latch recess 32. The substantially planar portion 28 of the base member 22 includes a plurality of holes through which suitable screw fasteners 34 may be received for mounting the base member 22 to the door frame support member 16.

The raised portion 30 lies in a plane which is displaced from and substantially parallel to the substantially planar portion 28 of the base member 22. The raised portion 30 is smoothly joined therewith by a plurality of inclined surfaces 36, 38, and 40. As will be more fully described hereinafter, the inclined surfaces 36 and 40 lead towards the latch recess 32 and serve to guide a latch projection of the handle 24 into locking engagement with the latch recess 32.

The handle 24 is pivotally mounted on the base member 22 at a pivot point defined by a pin 42 at the end of the base member 22 opposite the raised portion 30 and latch recess 32. The handle 24 includes an elongate offset portion 44 of suitable dimension to afford convenient gripping by the hand of an operator. The lower end of the handle 24 includes an inwardly projecting portion 46 which extends from the elongate portion 44 towards the base member 22. The portion 46 terminates in a latch projection 48 which is utilized in accordance with one particular aspect or feature of the present invention to be described hereinafter to allow the latch assembly to be retained in a locked position.

The upper end of the handle 24 includes an upper portion 50 to which the hook member 26 is pivotally mounted by a pin 52. The handle 24 is pivotally mounted to the base member 22 by the pin 42 at the upper portion 50 and at a pivot point intermediate the ends of the handle 24.

The hook member 26 includes an external thread 54 which is threadingly received by the pin 52 to render the displacement between the hook end 56 of the hook member 26 from the pin 52 adjustable. The hook end 56 is adapted to engage a staple or eyelet 58 provided in the door panel 10 to be drawn against the door support frame member 16. Because the hook member 26 is pivotally mounted to the handle 24 by pin 52, the latch assembly of FIG. 2 is non-handed (i.e. neither right nor left handed). Thus, the hook member 26 is adapted to be rotated from its left hand position as shown in FIG. 2 to a right hand position. Therefore, a latch assembly constructed in accordance with the latch assembly 20 could be utilized for drawing the door panel 12 up against the support frame member 16 without necessitating replacement of parts in the latch assembly or the like.

The pivotal connection between the handle 24 and the base member 22 is best illustrated in FIGS. 3 & 4. The pin 42 includes a shaft 60 and a flange 62. The shaft 60 extends through an aperture 64 of the upper portion 50 of handle 24 and an aperture 66 of the base member 22. The base member 22 includes an embossment 68 about the aperture 66. The shaft 60 includes a threaded bore which is arranged to receive a threaded fastener 70. Between the head of the fastener 70 and the rear surface of the base member 22 there is provided a washer 72. Lastly, and in accordance with a particular aspect of the present invention, a biasing means in the form of a coiled spring 74 is disposed between the flange 62 of pin 42 and the front surface of the handle 24 so as to force the handle against the base member 22 for providing friction engagement therebetween and, as will be described hereinafter, for forcing the latch projection 48 into locking engagement with the latch recess 32 of the base member 22.

As thus far described, the latch assembly of FIG. 2 operates as follows. First, the handle 24 is rotated in a counterclockwise direction to allow the hook end 56 of hook member 24 to engage the eyelet 58. Thereafter, the handle 24 is rotated in a clockwise direction so as to draw the door panel up against the support frame member 16. As the handle 24 is rotated in the clockwise direction, the latch projection 48 engages and rides up the inclined surface 48. As the latch projection 48 rides up the inclined surface 40, the coiled spring 74 will yield to allow the latch projection 48 to enter the latch recess 32. FIG. 3 shows the position of the latch projection 48 immediately prior to engagement with the latch recess 32. Upon reaching the latch recess 32, the latch projection 48 under the influence of the coiled spring 74 will be forced into the latch recess and retained therein for locking the door panel 10 and the latch assembly 20. Preferably, the hook member 26 is threaded into the pin 52 such that as the latch projection enters the latch recess upon rotation of the handle to a position where the door is drawn against the support member, the latch projection will enter the latch recess for retaining the handle and the door in a locked position.

Referring now to FIGS. 5 and 6, it will be noted that the handle 24 may be disposed and retained in an inverted unlocked rest position substantially in line with the base member 22. The handle 24 is disposed and retained in this position by the friction engagement between the handle 24 and the base member 22 caused by the coiled spring 74. Also, as may be best noted in FIG. 5, the hook member 26 by being pivotally connected to the handle 24 by pin 52, will also assume an inverted position substantially in line with both the handle 24 and the base member 22. As a result of the foregoing, the latch assembly of the present invention may be conveniently disposed in an unlocked position with no portion thereof extending into the door opening to permit equipment to be readily passed therethrough.

Referring now to FIGS. 7–11, further details of the latch assembly may there be noted. As best seen in FIG. 10, the latch recess 32 includes an inner surface or rim 80 and the latch projection 48 includes a pair of opposed notches the notches are displaced from the end of the latch projection 48 so that they are aligned with the rim 80 of the latch recess 32 when the latch assembly is in a locked position. As may be noted by the broken line representation in FIG. 10, the notch 82 is arranged to receive the rim 80 of the latch recess 32 to securely lock the latch assembly. As a result, the handle 24 is precluded from being inadvertently rotated once the latch assembly is locked. Furthermore, the coiled spring 74, as previously described, forces the latch projection 48 into the latch recess 32 and causes the latch projection 48 to be retained therein. Hence, in order to unlock the latch assembly, it is necessary for an operator to align the latch projection 48 with the latch recess 32 and to thereafter intentionally and positively displace the handle 24 away from the base member 22 to overcome the bias of the coiled spring 74 in order to unlock the latch assembly.

In FIG. 7 the latch assembly is shown in a locked position (full lines) and in a position prior to being locked (broken lines). As previously described, for locking the door panel 10, the handle 24 is first rotated in a counterclockwise direction to allow the hook end 56 of hook member 24 to enter the eyelet 58. Thereafter, the handle 24 is rotated in a clockwise direction about the pin 42 from the broken line position to the solid line position as shown whereat the latch projection 48 is received within the latch recess 32 for locking the door and the latch assembly. As may be best noted in FIG. 9, as the handle 24 is rotated, the latch projection 48 is permitted to ride up the inclined surface 48 by virtue of the yieldable coiled spring. However, once the handle 24 reaches the position shown in FIG. 8, the projection 48 is positively forced into the latch recess 32 by the coiled spring 74 for locking the door panel and the latch assembly. Once the latch projection is firmly within the latch recess as shown in FIG. 11 the handle and the door are locked.

From the foregoing it can be appreciated that the present invention provides a new and improved latch assembly for drawing a free hanging door up to a support member and holding the door there against. The latch assembly of the present invention is not only non-handed, but additionally, is self-actuating so that only one hand of an operator is required for locking or unlocking the latch assembly. Furthermore, the novel manner in which the handle is pivotally connected to the base member allows the handle to be disposed in an inverted substantially vertical position in line with the base member and retained in that position through the action of the coiled spring. Hence, the latch assembly of the present invention may be disposed and retained in an unlocked rest position without obstructing passage through the doorway defined by the door frame.

The invention is claimed as follows:

1. A latch assembly for drawing a free hanging door up to engagement with a support member and holding the door there against, said latch adapted to be mounted on said support member and comprising; a base member for mounting to the support member and including a raised portion having a latch recess formed therein, and actuating member pivotally mounted to said base member about a pivot point, said actuating member being of an integral construction including an upper actuating portion on one side of said pivot and a handle portion on the other side of said pivot; and hook means carried by said actuating portion and arranged for engaging the door; said handle portion including a transversely extending projecting portion terminating in a latch projection, said latch projection being arranged to enter said latch recess upon rotation of said actuating member to a position wherein the door is drawn against the support member and for retaining said actuating member and door in a locked position; and biasing means at said pivot point urging said actuating member against said base member, which biasing means permits the entire actuating member to move laterally of said base member such that the latch projection may be disposed within the latch recess with the force of said biasing means serving to retain the latch projection in said latch recess and also providing frictional engagement between said actuating member and said base member capable of retaining said actuating member in an unlocked position substantially in line with the support member.

2. A latch assembly as defined in claim 1 wherein said hook means is pivotally coupled to said actuating member to permit either right or left hand mounting of said lock assembly.

3. A latch assembly as defined in claim 1 wherein said raised portion includes a ramped surface for guiding said latch projection into said latch recess.

4. A latch assembly as defined in claim 1 wherein said raised portion includes a pair of inclined surfaces leading towards said latches recess from respective opposite sides thereof for guiding said latch projection into said latch recess.

5. A latch assembly as defined in claim 1 wherein said biasing means comprises a coiled spring.

6. A latch assembly as defined in claim 1 wherein said latch recess includes an inner rim and wherein said latch projection includes at least one notch for lockingly engaging said rim.

* * * * *